United States Patent [19]

Lurie

[11] Patent Number: 4,779,198

[45] Date of Patent: Oct. 18, 1988

[54] AUDIENCE MONITORING SYSTEM

[75] Inventor: Oscar M. Lurie, Bethesda, Md.

[73] Assignee: Control Data Corporation, Minneapolis, Minn.

[21] Appl. No.: 148,098

[22] Filed: Jan. 26, 1988

Related U.S. Application Data

[63] Continuation of Ser. No. 900,775, Aug. 26, 1986, abandoned.

[51] Int. Cl.[4] ..... H04H 9/00

[52] U.S. Cl. ..... 364/419; 358/84; 455/2

[58] Field of Search ..... 364/419; 340/555–557; 358/84; 455/2

[56] References Cited

U.S. PATENT DOCUMENTS

| | | | |
|---|---|---|---|
| 3,210,472 | 10/1965 | Kanen . | |
| 3,814,841 | 6/1974 | Ulicki . | |
| 3,947,624 | 3/1976 | Miyake . | |
| 3,947,669 | 3/1976 | Simmons et al. . | |
| 3,993,955 | 11/1976 | Belcher et al. . | |
| 4,047,227 | 9/1977 | Rzeszewski . | |
| 4,107,734 | 8/1978 | Percy et al. . | |
| 4,107,735 | 8/1978 | Frobach . | |
| 4,231,031 | 10/1980 | Crowther et al. . | |
| 4,290,141 | 9/1981 | Anderson et al. . | |
| 4,308,554 | 12/1981 | Percy et al. . | |
| 4,377,870 | 3/1983 | Anderson et al. . | |
| 4,517,564 | 5/1985 | Morishita et al. . | |
| 4,546,382 | 10/1985 | McKenna et al. . | |
| 4,566,030 | 1/1986 | Nickerson et al. . | |
| 4,567,511 | 1/1986 | Smith et al. . | |
| 4,578,700 | 3/1986 | Roberts et al. . | |
| 4,603,232 | 7/1986 | Kurland et al. | 358/84 |
| 4,626,904 | 12/1986 | Lurie | 455/2 |
| 4,644,509 | 2/1987 | Kiewit et al. | 358/84 |
| 4,658,290 | 4/1987 | McKenna et al. | 358/84 |
| 4,695,879 | 9/1987 | Weinblatt | 358/84 |

*Primary Examiner*—Jerry Smith
*Assistant Examiner*—Allen MacDonald
*Attorney, Agent, or Firm*—Cushman, Darby & Cushman

[57] ABSTRACT

Each doorway or passageway between rooms in which a device may be located is fitted with another device which detects motion and the direction of the motion through the passage. Each room is equipped with a signal emitter that is controlled by the motion detector at the room's passage. The signal emitted by the signal emitter is received by a monitor which monitors the status of the device which happens to be located in that room. The emitted signal informs the monitor when there has been motion into the room (audience increase) or when there has been motion out of the room (audience decrease). Motion between rooms will result in a decrease signal being sent by the signal emitter in one room and an increase signal being sent by the signal emitter in the other room. If no device and monitor are located in a room, the increase or decrease signal is ignored by the audience monitoring system. If a monitor is located in the room, however, the increase or decrease signal received by it from the signal emitter will cause the monitor to issue an immediate prompt, to remind the persons in the room to push the keys of an inputting device to report the identity of the individuals who just entered or departed. The monitor will record this information, the time of day, and information received from the inputting device, such as channel selection and the like in the case of a television.

56 Claims, 8 Drawing Sheets

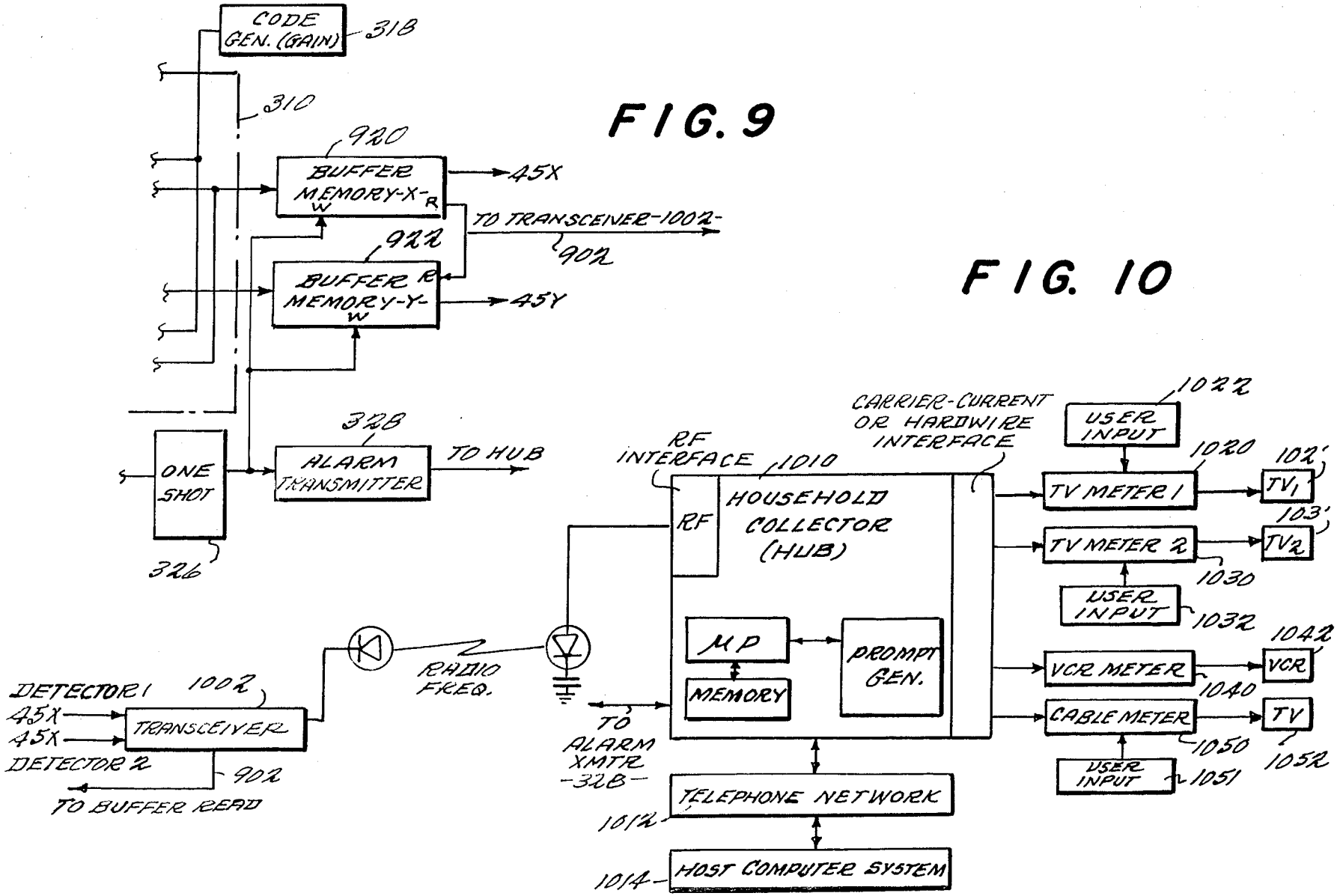
FIG. 9
CODE GEN. (GAIN)
318
310
BUFFER MEMORY-X-R W
920
BUFFER MEMORY-Y-R W
922
45X
45Y
TO TRANSCEIVER-1002-
902
ONE SHOT
326
ALARM TRANSMITTER
328
TO HUB
FIG. 10
USER INPUT
1022
TV METER 1
1020
TV1
1022'
TV METER 2
1030
TV2
1032'
USER INPUT
1032
VCR METER
1040
VCR
1042
CABLE METER
1050
TV
1052
USER INPUT
1051
CARRIER-CURRENT OR HARDWIRE INTERFACE
HOUSEHOLD COLLECTOR (HUB)
1010
RF INTERFACE
RF
μP
MEMORY
PROMPT GEN.
TELEPHONE NETWORK
1012
HOST COMPUTER SYSTEM
1014
TO ALARM XMTR -328-
RADIO FREQ.
TRANSCEIVER
1002
902
DETECTOR 1
DETECTOR 2
45X
45X
TO BUFFER READ

AUDIENCE MONITORING SYSTEM

This is a continuation of application Ser. No. 900,795, filed Aug. 26, 1986, which was abandoned upon the filing hereof.

BACKGROUND OF THE INVENTION

1. Field of the Invention

The present invention relates to a system for monitoring the population in a room using a device such as a television. More particularly, the present invention relates to such a monitoring system in which the entry into or exit from the room is monitored.

2. Description of the Prior Art

The prior art is replete with various systems and arrangements for monitoring the use of devices. An example is monitoring the channel tuning habits of television viewers. The earliest such systems merely collected the data on site for eventual manual collection as to the television channels viewed and the times of viewing for various panels of viewers in order to determine market share and ratings of various television programs. Later, systems came into being for use with cable television systems with two-way communications over the cable system between the head end and various cable subscribers. In such a system, the television sets were typically interrogated periodically from the central location over the cable, with the channel selection and time information being sent back to the central location and logged for statistical compilation. Such systems have also been used in the past in pay television systems in which billing information was sent over the cable system from a central location to the various subscribers of the pay television system. The prior art also includes such systems in which a memory was provided at the remote location, i.e., at the television receiver, for accumulating data as to the channel being tuned in at the time. The accumulated data was then periodically transmitted over conventional telephone lines from the remote locations to the central location by telephone calls initiated by either the remote stations or the central location.

Systems for remotely accumulating data regarding the habits of television viewers and their qualitative reaction to television programming have today become important from the standpoint of market research. Several prior art systems enable the viewer's preferences to be monitored. For example, the effectiveness of television programming can be monitored by remote control devices used by audience members who may enter their reaction to broadcast programs displayed on their television screens. Such systems are disclosed in U.S. Pat. Nos. 4,107,734 and 4,308,554, both to Percy et al. In these systems, the information received by the remote control device is inputted to a localized interrogator and later dumped to a central computer. This apparatus may be used for determining which channel the set is on and viewer reactions to the displayed broadcast over that channel.

Another approach of the prior art has been to use "people meters". With these people meters, each television set is furnished with one or more remote-control devices which are pressed at the start and finish of viewing to record each person's watching patterns. Thus, this system operates effectively as an electronic diary in which the television viewing patterns of each individual are recorded. As the demands for more precise information about the individual viewers' habits and preferences developed, however, such electronic diaries were no longer sufficient.

Advertising agencies, who buy billions of dollars worth of commercial time on the main networks each year, want to know not only the number of homes with television sets tuned to a particular program, but the actual number of people watching a particular show. With that information, and with breakdowns of sex, age and income, ad agencies will be better able to tell their clients how to reach the viewer they want. As a result, viewer interactive devices such as that disclosed in U.S. patent application Ser. No. 658,378, now U.S. Pat. No. 4,658,290 to McKenna et al., incorporated herein by reference, have developed. The data gathering system of McKenna, for example, utilizes an elapsed time clock to generate prompts at predetermined intervals of time, and the viewer may respond to these prompts by inputting the desired information. In operation, the McKenna system flashes a message on a television screen every thirty minutes or so that asks "Who's watching?" The message will not go away until viewers punch in codes on an attached keypad reporting the individuals in the room so that the system can determine the age and sex of everyone in the room. The McKenna system, therefore, automatically provides prompts at periodic intervals to remind people viewing the television set to push the keys if persons have entered or left the vicinity of the television set since the keys were previously pushed, or to confirm that the viewers have not changed. This system has several shortcomings, however, which it is the purpose of the present invention to correct. Such short-comings include:

1. When persons arrive or depart, they may fail to push the appropriate keys, i.e., to immediately enter the required information without waiting to be prompted to do so. This is especially the case with small children. Such a failure obviously reduces the accuracy of data collected.

2. When a prompt automatically occurs, the persons may push the buttons which confirm no change in viewers, despite the fact that persons have actually arrived or departed since the last previous key entries were made. The resulting deficiencies in the received information are commonly handled by computer editing procedures which make certain assumptions about arrivals, departures, or absence of change. Consequently, the entire resulting file of data concerning viewing by people is suspect. In particular, the value of the data is depreciated when its user desires accurate knowledge of the size and composition of the audience that was exposed to a particular advertising message which was aired during a specific 15 or 30 second interval.

3. Since these systems require active and continuous cooperation by members of the household, many households refuse to allow their installation. Others tire of the activity imposed on them and demand that the monitoring equipment be removed. The result may be the injection of what sampling statisticians call "non-response bias", which can be fatal to the usability and acceptance of the overall audience estimates produced by the system. For these reasons, operators of television audience measurement systems offer financial incentives to induce the pre-selected sample households to allow installation of the equipment and to continue its use. The effectiveness of these incentives, however, usually varies inversely with the socio-economic status of the households and with their values and attitudes. Hence, non-response bias may persist, despite the high cost of the financial incentives to the system operators. Obtaining and maintaining the cooperation of various types of households (those of single persons, the aged, certain ethnic populations, etc.) is also a continuing problem.

OBJECTS AND SUMMARY OF THE INVENTION

The present invention relates to an improved system and method for monitoring the use of a device. As merely one example, the present invention may be used to monitor the audience to television programs in sample households. The present invention will issue prompts at more appropriate times, such as when the television set is turned on or when persons enter or exit the room. The present invention will also give the exact time of arrivals and departures of television viewers, thereby providing a more accurate record of who is viewing a particular television program at a given time.

Therefore, the present invention overcomes the above-mentioned disadvantages of the prior art by providing improved systems for determining the use of devices. The present invention improves initial and continuing acceptance of such monitoring systems by the pre-selected sample households which are monitored. Thus the present invention provides the sample households with a positive incentive to permit installation of the system, which is effective regardless of the socio-economic status, values, etc., of the particular pre-selected sample household.

In accordance with one embodiment of the present invention, each doorway or passageway between rooms in which a device, such as a television receiver, for example, may be located is fitted with a device which detects motion and the direction of the motion through the passage. Each room is also equipped with a signal emitter that is controlled by the motion detector at the room's passage. The signal emitted by the signal emitter is received by a monitor which monitors the status of a a device in that room. The emitted signal informs the monitor when there has been motion into the room (audience increase) or when there has been motion out of the room (audience decrease). Motion between rooms will result in a decrease signal being sent by the signal emitter in one room and an increase signal being sent by the signal emitter in the other room. If no device and monitor are located in a room, the increase or decrease signal is ignored by the audience monitoring system. If a device and monitor are located in the room, however, the increase or decrease signal received by it from the signal emitter will cause the monitor to issue an immediate prompt, to remind the persons in the room to push the keys to report the identity of the individuals who just entered or departed. The monitor will record this information, the time of day, and information received from the device, such as channel selection in the case of a television receiver, and the like. Such an apparatus may be incorporated into the system disclosed by McKenna et al. in U.S. patent application Ser. No. 658,378, now U.S. Pat. No. 4,658,290.

Another embodiment of the present invention utilizes motion detectors which may be used to distinguish the passage of a small child from that of an adult through a passage. This is accomplished by utilizing motion detectors made up of beams of light directed across the doorway or passageway at different heights. The heights are chosen such that the highest of at least two beams is not interrupted by the passage of a small child. Consequently, when only the lower of the beams is interrupted, a signal is generated indicating that a small child has entered or exited the room. As a result, the audience monitoring system of the present invention can identify the passage of children without generating a prompt on the television screen. This is useful because small children are considered to be part of the same audience demographic category for statistical purposes, thus no additional information needs to be provided.

The present invention may also include a timing means which is activated when at least one of the beams of light across the passageway is interrupted for longer than a predetermined interval of time. After the predetermined interval of time has passed, a unique code is generated which indicates that a door across the passage to the room has been closed. In such a situation, no prompt will be displayed.

In accordance with a further embodiment of the present invention, the functions of the television monitoring devices, and the information they detect are controlled by, reported to, and stored in a single device called a household collector (HUB). The HUB unit will collect, time stamp, log, and transfer to a remote host computer all the information gathered by those monitors installed on its local network. The HUB may also be described as a gateway or protocal converter between the household metering network and the telephone network connecting the monitoring system to the host computer system. In the present invention, the HUB will process and store the data received from each television monitor and the information received from each motion detection device.

Acceptance of the present invention should be improved, for prompts are required in only two situations: when the television set is initially turned on, or when there is any increase or decrease in the number of persons in the room where the television set is located. This eliminates the annoyance to viewers caused by present systems which issue prompts at periodic or random intervals, thereby requiring responses even though no change in viewers may have occurred. Consequently, initial and continuing acceptance of the system by the preselected sample households will be improved by the present invention.

As a further incentive for the acceptance of the present invention in sample households, the motion detectors may be electrically connected to an audible alarm which is activated by the user. When motion is detected anywhere in the household, the alarm will sound until it is switched off. If desired by the members of the household, an autodialer can also be installed so that the household's telephone line can be used to report possible intrusions to the public authorities or to commercial intrusion detection services.

Although the preferred embodiment will be described below with respect to a television monitoring system, the present invention may be employed to monitor the use of many other devices.

BRIEF DESCRIPTION OF THE DRAWINGS

These and other objects and advantages of the present invention will become more apparent and more readily appreciated from the following description of the presently preferred exemplary embodiments thereof, taken in conjunction with the accompanying drawings, of which:

FIG. 9 is a block diagram and partial schematic diagram of yet another embodiment of a motion detector of the present invention appropriate for use with a household collector;

FIG. 10 shows an exemplary embodiment of a household collector (HUB) used in accordance with another embodiment of the present invention.

DETAILED DESCRIPTION OF THE PRESENTLY PREFERRED EXEMPLARY EMBODIMENTS

A preferred embodiment of the present invention, to be described below, relates to a data gathering system for television which includes a plurality of remote units which are controlled from a central location. Each of the remote units is attached to a television receiver which may be but is not necessarily attached to a cable system. Each of the remote units functions to determine television channel selection data and receive data from motion detectors in accordance with the present invention. This data is stored for later transmission to a central data collecting point. A more detailed description of such an overall system is provided in U.S. Patent application Ser. No. 658,378 to McKenna, which has been incorporated herein by reference.

An exemplary embodiment of the present invention includes a data gathering system such as that of McKenna which has been modified to receive data from a motion detection device in accordance with the present invention. The system is designed such that whenever motion is detected by the motion detection device, activity of the monitoring system is interrupted, and a prompt is generated for the persons who may be near the television receiver. An example of the implementation of such a system in a sample household will be provided with respect to FIG. 1

Figure 1:
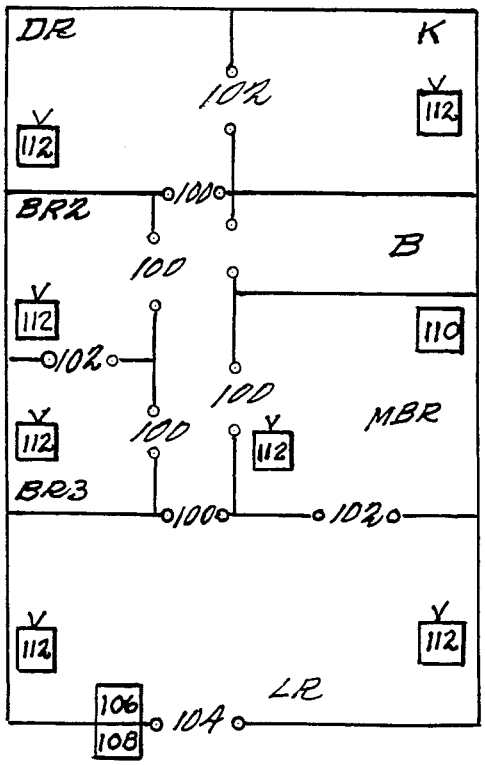
FIG. 1 schematically illustrates possible locations for the devices of the present invention when installed in a sample dwelling unit.

FIG. 1 illustrates a dwelling unit which contains a kitchen (K), a dining room (DR), a bathroom (B), a master bedroom (MBR), two other bedrooms (BR2, BR3), and a living room (LR) which have been equipped with the audience monitoring system of the present invention. Passages between the rooms are designated with numerals 100 or 102, with the passages designated as 100 located between one room containing a television monitoring device and a room without such a device and with the passages designated as 102 located between rooms which both include a television monitoring device. The outside entry into the dwelling unit is designated as 104. A manual switch near the entry used for operating an alarm is designated as 106, and the audible outside alarm is designated as 108. At his option, the resident of the dwelling unit equipped with the device according to the present invention may also have a telephone autodialer 110 installed in any convenient location near a power outlet and a telephone terminal box (shown in FIG. 1 in the master bedroom). Reference 112 is used to designate a television receiver equipped with a monitoring device. For the purposes of FIG. 1, it is assumed that a television set and monitor may be placed in any of the rooms other than the bathroom and that the living room may contain more than one television set and monitor. Consequently, a motion detection device is installed at all passages designated 100, 102 and 104, but not at the passage to the bathroom.

Figure 2:
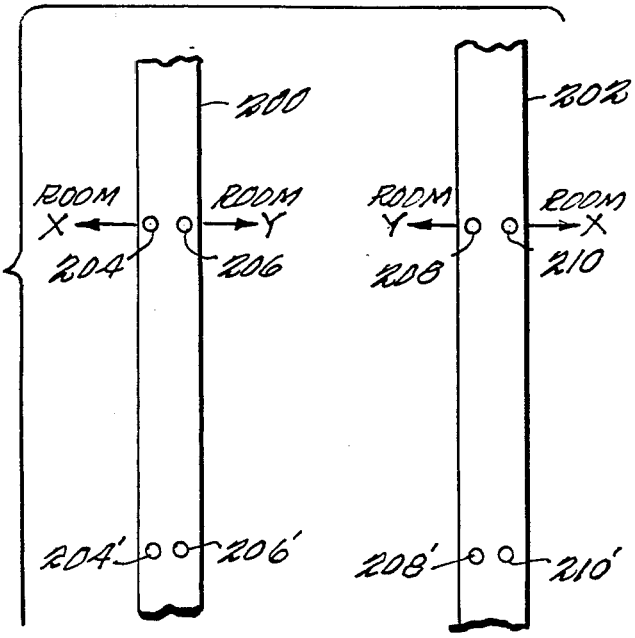
FIG. 2 schematically illustrates the installation of a motion detector on a passage between rooms.

FIG. 2 illustrates the installation of a motion detector on a passage into or between rooms X opposing faces of the passage (the door and Y. The jambs or walls) are designated 200 and 202. Affixed to one side of the passage are two light emitters 204 and 206. These light emitters are closely focused to be received separately and discretely by photocells 210 and 208, respectively, which are fixed in the same relative positions on the opposing sides of the passage. More than one set of emitters and photocells may be affixed at different heights on the opposing sides of the passage (as shown by emitters 204' and 206' and photocells 208' and 201'). This feature will be discussed in more detail below with reference to FIG. 7.

The light emitters 204 and 206 and photocells 208 and 210 are arranged such that two beams of light, parallel to each other, cross the passage at a height such that the beams of light are interrupted by the passage of a person through the passageway. Two beams of light are used to determine the direction of the motion through the passageway. For example, if a person moves through the passageway from room X toward room Y, the light beam between emitter 204 and photocell 210 will be interrupted before the interruption of the beam between emitter 206 and photocell 208. The reverse would be true if the person moves through the passage from room Y toward room X. The detected direction of motion will cause an audience increase or an audience decrease signal to be generated, as will be discussed in more detail below with reference to FIG. 3.

Figure 3:
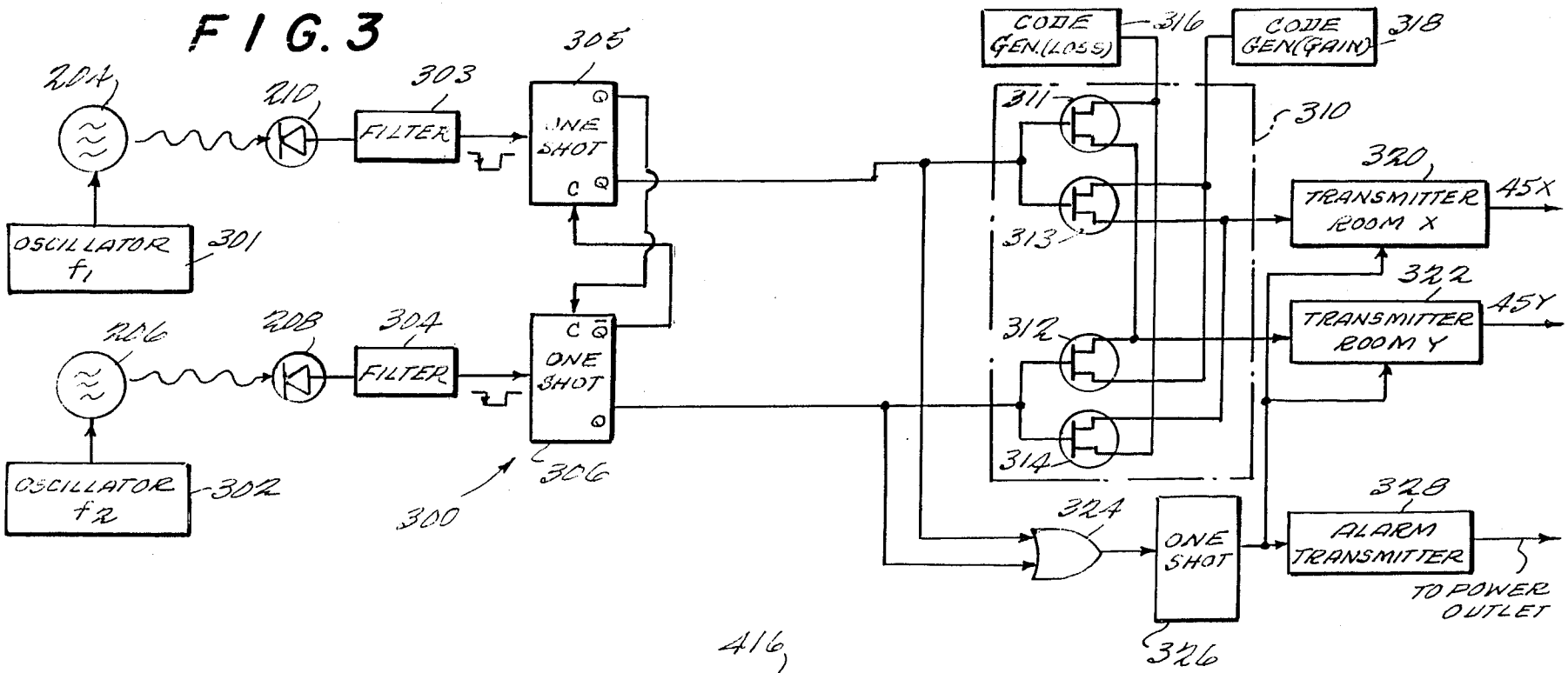
FIG. 3 is a block diagram and partial schematic diagram illustrating an exemplary embodiment of a motion detector in accordance with the principals of the present invention.

Referring to FIG. 3, there is shown an exemplary embodiment of a motion detector in accordance with the present invention. Motion detection device 300 may be placed at each passageway of a dwelling unit as shown by 102 in FIG. 1. (A detector of the type for a passage designated 100 or 104 is not shown since it is the same except that only one signal emitter is needed.) Light emitters 204 and 206 and photocells 208 and 210 correspond to those shown in FIG. 2. In addition, to reduce the precision of the focusing required between the light emitters and the photocells, it may be desirable to radiate the two light beams at different frequencies. Oscillators 301 and 302 have been added for this purpose, and a pair of filters 303 and 304 have also been added between photocells 208 and 210 and the circuits which they drive. Filters 303 and 304 pass a high level signal from photocells 208 and 210 when the light beams are continuous, in other words, when no motion has been detected. When one of the beams has been interrupted, however, the output of the corresponding photocell through the filter changes to a low state.

For purposes of illustration, it will be assumed that the beam of light between light emitter 204 and photocell 210 was interrupted before the light beam between light emitter 206 and photocell 208. As a result, the falling edge of the output of filter 303 triggers one-shot 305 which contains Q and $\overline{Q}$ outputs. One-shot 305 generates an output pulse with a duration greater than the length of time required by a person to traverse the distance between the first light beam and the second light beam. Before the light beam has been interrupted, one-shots 305 and 306 have Q outputs which are in the low state and $\overline{Q}$ outputs which are in the high state. The $\overline{Q}$ output of one-shot 305 is connected to the clear input C (which may be an enable input) of one-shot 306, and the $\overline{Q}$ output of one-shot 306 is connected to the clear (or enable) input C of one-shot 305. As a result of this interconnection, only a single one-shot can be active at any given time. Consequently, when the rising edge of the output of filter 303 is received by one-shot 305, a pulse of a predetermined duration is outputted, thereby changing the Q output to a high state and the $\overline{Q}$ output of one-shot 305 toaa low state disabling one-shot 306. Therefore, when the second light beam is broken and a rising edge is received by one-shot 306, no pulse will be outputted. In this manner, only one pulse output will be generated for each movement through the passageway.

The Q outputs of one-shots 305 and 306 are then inputted into switching network 310 comprised of FET transistors 311, 313, 312, and 314. The output of one-shot 305 is connected to the gate of FET transistors 311 and 313, and the output of oneshot 306 is connected to the gate of FET transistors 312 and 314. These FET transistors function as switches, for when a high input is received at the gate, conduction occurs between the source and the drain The source of FET transistors 311 and 314 are connected to a code generator 316, which generates a loss signal indicating that the audience has decreased. In other words, the output of code generator 316 is used to indicate that a viewer has left the room. Similarly, code generator 318 is connected to the source of FET transistors 312 and 313. Code generator 318 generates a gain signal indicating that the audience has increased, i.e. that a person has entered the room. The drains of FET transistors 311 and 312 are connected to a transmitter 322 for room Y, and the drains of FET transistors 313 and 314 are connected to a transmitter 320 for room X. Consequently, in the example given, when FET transistors 311 and 313 conduct, code generator 316 sends a loss signal to transmitter 322, and code generator 318 sends a gain signal to transmitter 320. The converse is true when FET transistors 312 and 314 conduct as a result of the output of one-shot 306.

The output of one-shots 305 and 306 are also connected to the input of OR gate 324, whose output is connected to another one-shot 326. Thus, when either beam has been interrupted, one-shot 326 will generate an output pulse signal which enables transmitters 320 and 322 and alarm transmitter 328. In the above example, transmitter 320 will then output the gain signal on line 45X and send it to a monitor in room X. Similarly, transmitter 322 will output the loss signal on line 45Y and send it to a monitor in room Y. The reverse is true when the beam to photocell 210 was the first to be interrupted; the gain code would be sent to room Y and the loss code to room X. When photocells 208 and 210 are located in a passageway between a room in which a television set and monitor may be placed and an area such as the bath, hallway, or outside entry (designated by 100 or 104 in FIG. 1) the output of one of the transmitters 320 and 322 is not used.

As noted above, the output of one-shot 326 may also be connected to an alarm transmitter 328. Alarm code transmitter 328 sends a code over the household power main to the manual switch 106 shown in FIG. 1. Alternatively, transmitter 328 can also generate a low power over the air radio signal to a receiver in front of the manual switch 106. If the user has activated manual switch 106, the outside alarm 108 is activated. Optionally, a telephone auto-dialer 110 may also be installed in any convenient location near a power outlet and telephone terminal box.

In situations where it is not feasible to run a wire from one side of the passage to the other, light emitters 204 and 206 can be powered by a separate transformer served by a power outlet on their side of the passage. Alternatively, each motion detector 300 may be battery operated.

Figure 4:
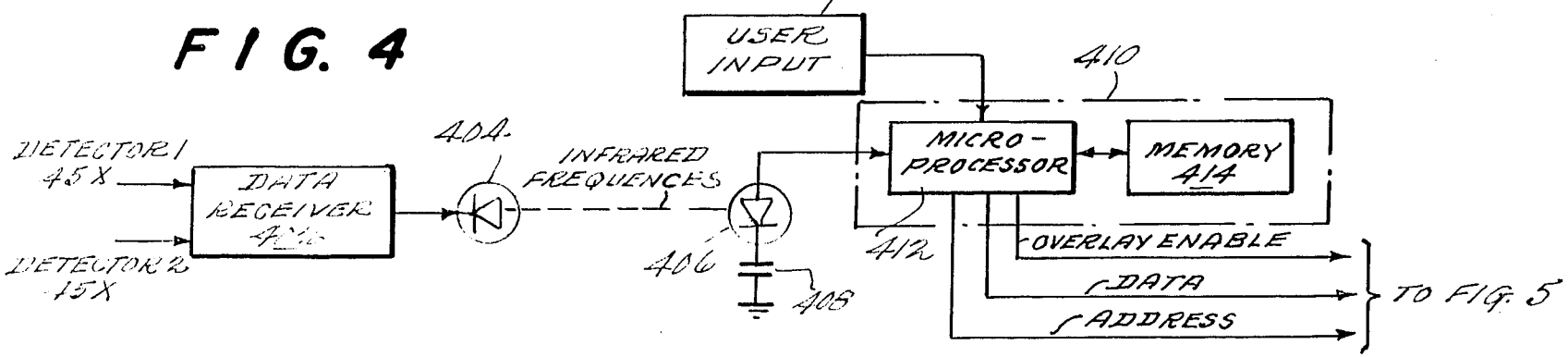
FIG. 4 is a block diagram of apparatus utilized for transmitting the output of a motion detector to a television monitor in accordance with the present invention.

FIG. 4 is a block diagram of a transmission system and monitoring device in accordance with an embodiment of the present invention. Receiver 402 receives as an input either the output of transmitter 320 or the output of transmitter 322, depending upon which room the receiver is in. Data receiver 402 may also receive the gain or loss codes from other motion detectors in the same room. Receiver 402 may contain, for example, a buffer memory for storing the gain or the loss signal. For distinguishing receivers in adjacent rooms, the receiver output may be modulated on different frequencies for transmitters in room X and room Y, respectively.

When there has been motion into or out of the room, the gain or loss code from receiver 402 is flashed by infrared radiating LED 404. The signal is received by infrared detection diode 406, which is mounted on the television set monitoring device, and is grounded through capacitor 408. The energy picked up by LED 406 is transferred to monitoring device 410. Monitoring device 410 may be of the type disclosed by McKenna in U.S. Patent application Serial No. 658,378. As in the McKenna system, monitoring device 410 comprises a microprocessor 412 and memory unit 414. The energy received by LED 406 is next transferred to the prompting logic in the monitor's microprocessor 412, which then logs the gain or loss code and the time of day into the monitor's memory 414. Microprocessor 412 generates an overlay enable signal which is received by a prompting generator (discussed in detail below with reference to FIG. 5). The microprocessor then determines if a gain or a loss code was received and sends the appropriate address for the gain or loss prompt to the prompting generator. The prompting generator then generates a gain or a loss prompt on the television screen. The prompt will remind the person or persons in the room to push the keys of input device 416 to indicate which persons have newly entered or exited the room. Information received from user input device 416 is then sent over a data line to the prompt generator, displayed on the television screen, and stored in memory 414.

Microprocessor 412 may be programmed to execute firmware commands which prevent a prompt in cases where a gain an a loss (or a loss and a gain) signal occur in rapid succession. Thus, when a person passes through a room without significant pause or momentarily leaves the room, no prompt will be generated. In order to implement such a feature, the received gain signal or loss signal is stored in temporary storage until a predetermined interval of time has passed. The predetermined interval of time may be on the order of several seconds, and during that time the microprocessor will wait for a signal indicating reverse movement through any of the passageways. If an indication of reverse movement is not received in the predetermined time interval, microprocessor 412 will send an overlay enable signal to the prompting generator. The information stored in the temporary storage portion of the memory will then be placed in the primary memory portion such that a log of entry and exit may be kept. In addition, a prompt may not be desired when a door across a passageway to the room is closed. Such an embodiment is discussed in more detail below with reference to FIG. 8.

It should be noted that the gain or loss signal transmitted by infrared radiating LED 404 is only picked up if a television and a monitoring device in a room adjacent the passage are activated. Thus each television monitor responds to the circuitry in that room only. Consequently, a prompt is generated only when the television and television monitoring device are both activated. In addition, some television sets are permanently located in a particular room, therefore, the receiver 402 would be part of the television set monitoring assembly, with wires 45X or 45Y connected directly to it. In this situation, elements 402, 404, 406, and 408 would not be needed.

Figure 5:
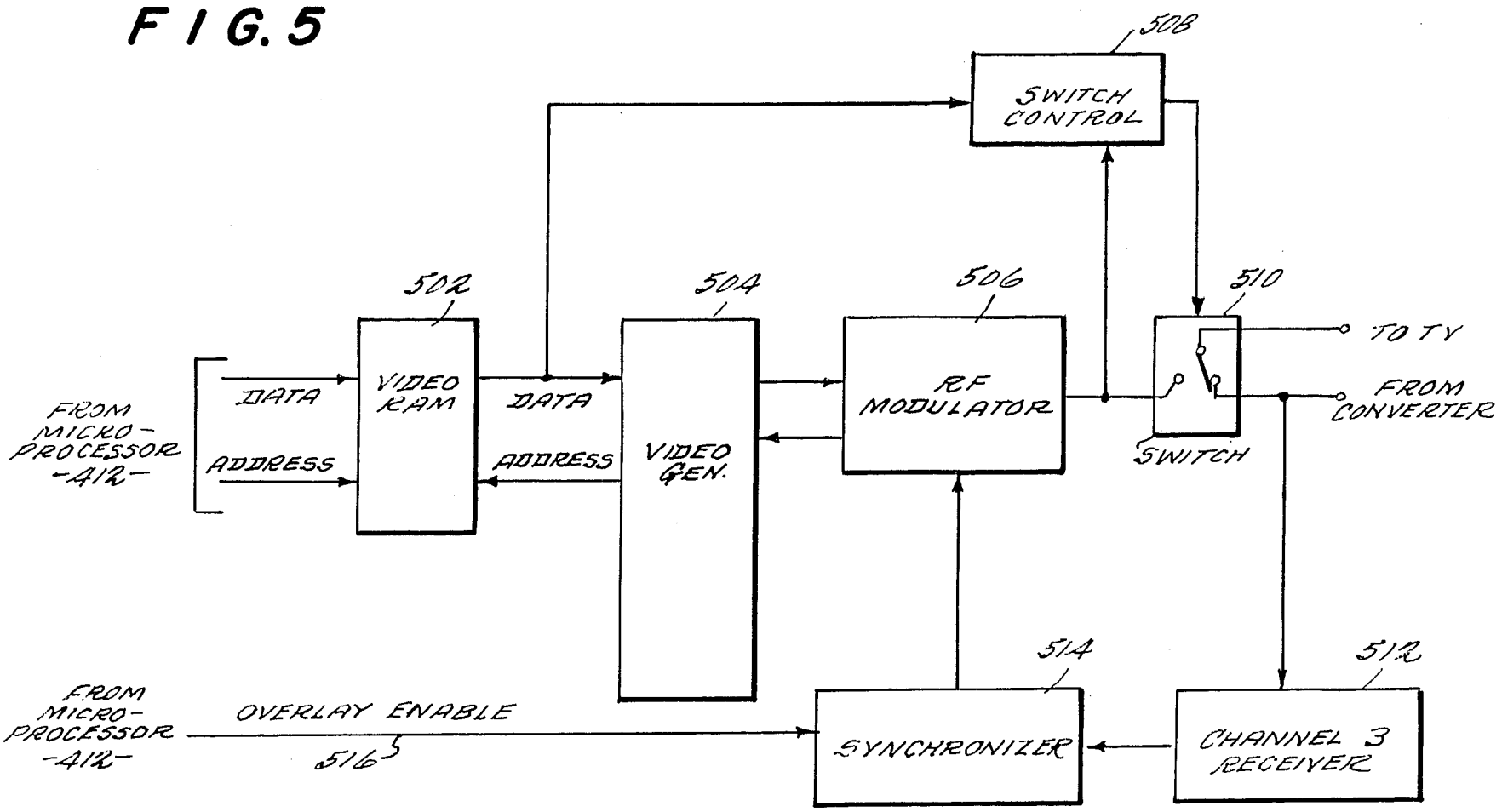
FIG. 5 is an embodiment of a prompt generator which may be used with the present invention.

Referring to FIG. 5, a prompt generating device which may be used with the present inventio is illustrated. A particular embodiment of this prompt generator is disclosed in the McKenna patent application. Obviously, the present invention may be employed with any other of the well known prompting systems with only minor changes well within the level of skill in the art. The McKenna prompt generating circuit, as one example, generates a gain or a loss prompt depending upon the data and address signals received from microprocessor 412. Video generator 504 reads the contents of RAM 502 and produces a video output. RAM 502 stores video data which is read as lines of 8 bit ASCII characters. This video data may represent a series of prompt signals which request information from the viewer such as the identification of people viewing the television, their sex, their age and the like. The output of video generator 504 is passed through an RF modulator 506 which is, in effect, a small television transmitter that sends a picture displaying the characters stored in the RAM 502. The carrier frequency for this signal is fixed to be identical to that of the output of a cable converter, which is usually channel 3.

In accordance with the exemplary embodiment of the present invention, which uses the prompt generator of McKenna, a cable converter converts all incoming television signals to a single output channel, for example, channel 3. A small receiver 512 is used to demodulate this RF signal and extract the vertical sync pulse. This pulse is fed into a synchronizer circuit 514, which starts the RF modulator 506 and video generator 504. The RF signal from RF modulator 506 is presented to a switch 510. The switch 510 is a suitable electronic switch for high speed switching of an RF signal. This switch selects the RF signal from either the cable converter or the RF modulator 506 and directs the selected signal to the television receiver.

Switch 510 is controlled by a switch control circuit 508. This switch control circuit 508 detects the border that appears around the area on the television screen where the text is written. The signal level change that occurs at the left edge of a screen of text is a trigger causing the switch control circuit 508 to set the switch 510 to select the output of RF modulator 506. The switch control circuit can also detect the transfer of a byte of data in which all the bits are set (i.e. hexadecimal FF) from the RAM 502 to the video generator 504. The detection of a data byte with all bits set causes the switch control circuit 508 to reset switch 510 to select the converter output.

The text can appear anywhere on the television screen. Each line of text is displayed until the end of the line or until a byte containing hexadecimal FF is read from the RAM 502. If a text line is not to be displayed, the byte corresponding to the first character of that line is set to hexadecimal FF. Full lines or portions of lines can be switched. The overall effect is that of lines of characters being displayed over the picture from the cable converter.

Microprocessor 412 controls this display via the RAM 502 and an overlay enable line 516. The microprocessor 412 first addresses RAM 502 to retrieve the characters representing the gain prompt or the loss prompt to be displayed and bytes of hexadecimal FF to define areas of the screen that are to remain unaffected. Characters received from the user input are also retrieved. When the microprocessor 412 sets the overlay enable line 516, the text is displayed over the normal picture. The overlayed text is removed when the microprocessor 412 clears the overlay enable line, which occurs after all input is received from the user.

It should also be noted that other forms of prompt generating devices may be used to request input from the television viewer. For instance, as in the McKenna patent, the prompt could be a light on a box or an audible buzzer. In addition, the prompt could take the form of a spoken reminder from a synthesized voice unit. Other devices may be used; however, each such device must effectively remind the viewer to input information to update the status of the audience composition after the detected movement.

In accordance with the exemplary embodiment of the present invention, a gain prompt or a viewer identification prompt is first issued when the television set is turned on. Subsequent prompts are issued when gain signals or loss signals are generated by the motion detectors as discussed with reference to FIG. 3. Each gain signal, each loss signal, and the information inputted by the user is recorded in the monitor's memory for subsequent transmission to a host computer system in accordance with the methods disclosed in the McKenna patent. In this manner, a complete account of the audience composition is recorded on a current basis for all of the television programming viewed by members of the sample household. The present invention thus allows more accurate records to be kept since the comings and goings of each viewer of a particular television show can be monitored. Application of the present device in the system of McKenna is shown in more detail with reference to FIG. 6.

Figure 6:
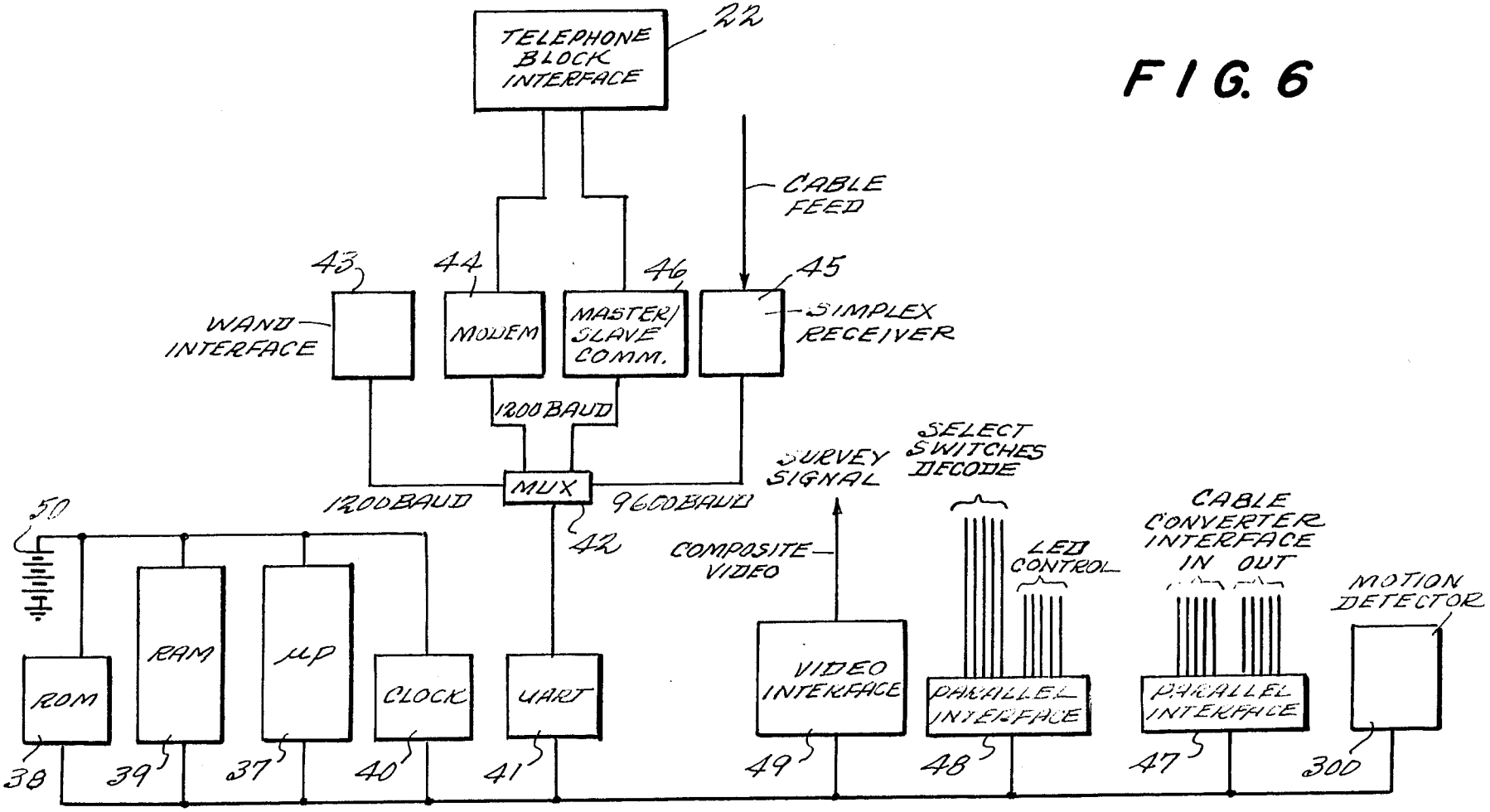
FIG. 6 is a detailed block diagram of an embodiment of a data collection unit in accordance with the present invention.

Referring now to FIG. 6, there is shown a functional block diagram of the McKenna data collection unit modified for use with the present invention. The data collection unit is operated by a microprocessor 37 which receives suitable programming contained in the ROM 38. A RAM 39 is provided for storing event information such as channel selection, television mode selection, and the identity of the viewers who are present. A clock 40 is also provided to run the microprocessor 37, with the clock 40 also functioning to maintain a time of day indication for recording times in connection with events stored in the RAM 39. The RAM 39 typically is provided with 32K bytes of storage, but more may be provided to implement the present invention.

Television monitoring device 410, discussed in FIG. 4 above, may be easily integrated into the system of McKenna. For example, microprocessor 37 of McKenna could be modified to perform the functions of microprocessor 412 of the present invention, and RAM 39 of McKenna could include further memory for storing the gain and loss codes as discussed above with reference to FIG. 4. ROM 38 of McKenna could also store additional programming data for processing the gain or loss codes.

As shown in FIG. 6, the McKenna system can be modified to include a further inteface, namely the motion detector 300 of the present invention. The data received from motion detector 300 could then be processed and stored in a manner similar to that provided for event information such as channel selection and television mode selection. In addition, the outputs of each motion detector in a room could be inputted into a slave data collection unit placed in that room, with each data collection unit operating in the manner disclosed above with reference to FIGS. 4 and 5. The information gathered by each of the slave data collection units may then be collected by a master data collection unit. The master data collection unit, for example, can poll each of the slave data collection units by carrier current over the low voltage telephone wiring to collect the available data at each of the slave data collection units, addressing each of these slave data collection units in series by code as necessary. Thus, all of the data from all of the various data collection units within a panelist's home will be stored in the master data collection unit. The information stored in the master data collection unit can then be transferred through the telephone block interface 22 to the host computer system in the manner disclosed by McKenna. A further embodiment of a master data collection unit which can be used with the present invention is discussed below with reference to FIG. 10. Other features of the elements shown in FIG. 6 are described in more detail with reference to FIG. 5 in the patent application of McKenaa, so they will not be discussed in further detail below.

Figure 7:
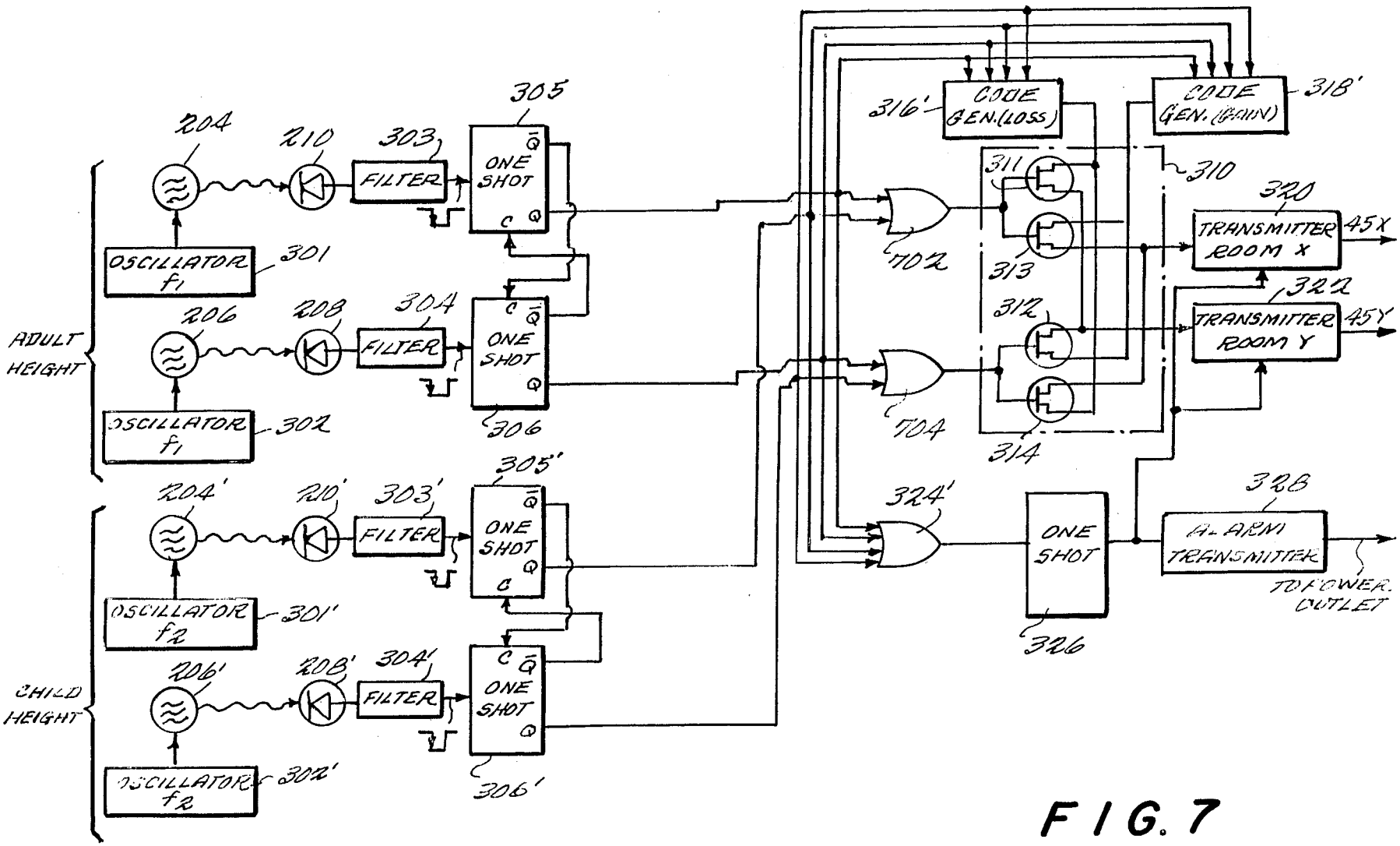
FIG. 7 is a block diagram and partial schematic diagram of an embodiment of the present invention appropriate for dwelling units in which small children reside.

FIG. 7 is a diagram showing an embodiment of the present invention appropriate for dwelling units in which small children reside. Components 204, 206, 301, 302, 208, 210, 30,, 304, 305 and 306 are duplicated, with one set of emitters and photocells installed in the passage at a height that would be interrupted only by an adult and a second set (indicated by the same numbers with a prime) installed at a height that would be broken by both an adult and a child. Oscillators 204 and 206 may operate at different frequencies than the oscillators 204' and 206' for the higher and lower beams, respectively. Other elements operate in the same manner described above with reference to FIG. 3. The higher and lower beams from corresponding sides of the passageway (adjacent room X, for example) are respectively inputted into OR gates 702 and 704. Whenever either or both of these beams are interrupted by movement through the passage, a pulse is generated in the same manner as described with reference to FIG. 3. In the present embodiment, however, the outputs of each one-shot is used as an input into the code generators 316' and 318'. These inputs enable the code generators 316' and 318' to determine whether the movement through the passageway was that of an adult or a child. An adult code would be generated when beams from 204 and 204' or 206 and 206' are interrupted at approximately the same time, whereas a child code would be generated when only beams from 204' or 206' are interrupted.

By way of example, if the beam received by photocell 210' was interrupted by movement through the passageway, one-shot 305' would generate a pulse indicating movement has been detected in the passageway. One-shot 306' would be disabled, and the outputs of one-shots 305 and 306 would remain the same since the higher beams were not interrupted. The code generators 316' and 318' would then generate a code indicating that a child has passed through the passageway, and in the given example, the output of loss code generator 316' would be connected to transmitter 320 for room X, and the output of gain code generator 318' would be connected to transmitter 322 for room Y. Such is the case because OR gate 702 would output a high signal, activating FET transistors 311 and 313. In addition, an OR gate 324' is connected to the output of each of the one-shots such that a transmit pulse is outputted by one-shot 326 only when motion has been detected by one or more of the motion detectors. Similarly, code generators 316' and 318' will send a code indicating that an adult has moved through the passageway whenever the higher beam and the lower beam on the same side of the passageway are approximately simultaneously interrupted. In addition, the prompting logic of microprocessor 412 would be modified to suppress all prompts in cases in which the gain or loss code is for children, but the children's gain or loss code will be stored in the monitor's memory 414 so that their viewing habits may be monitored as well.

Figure 8:
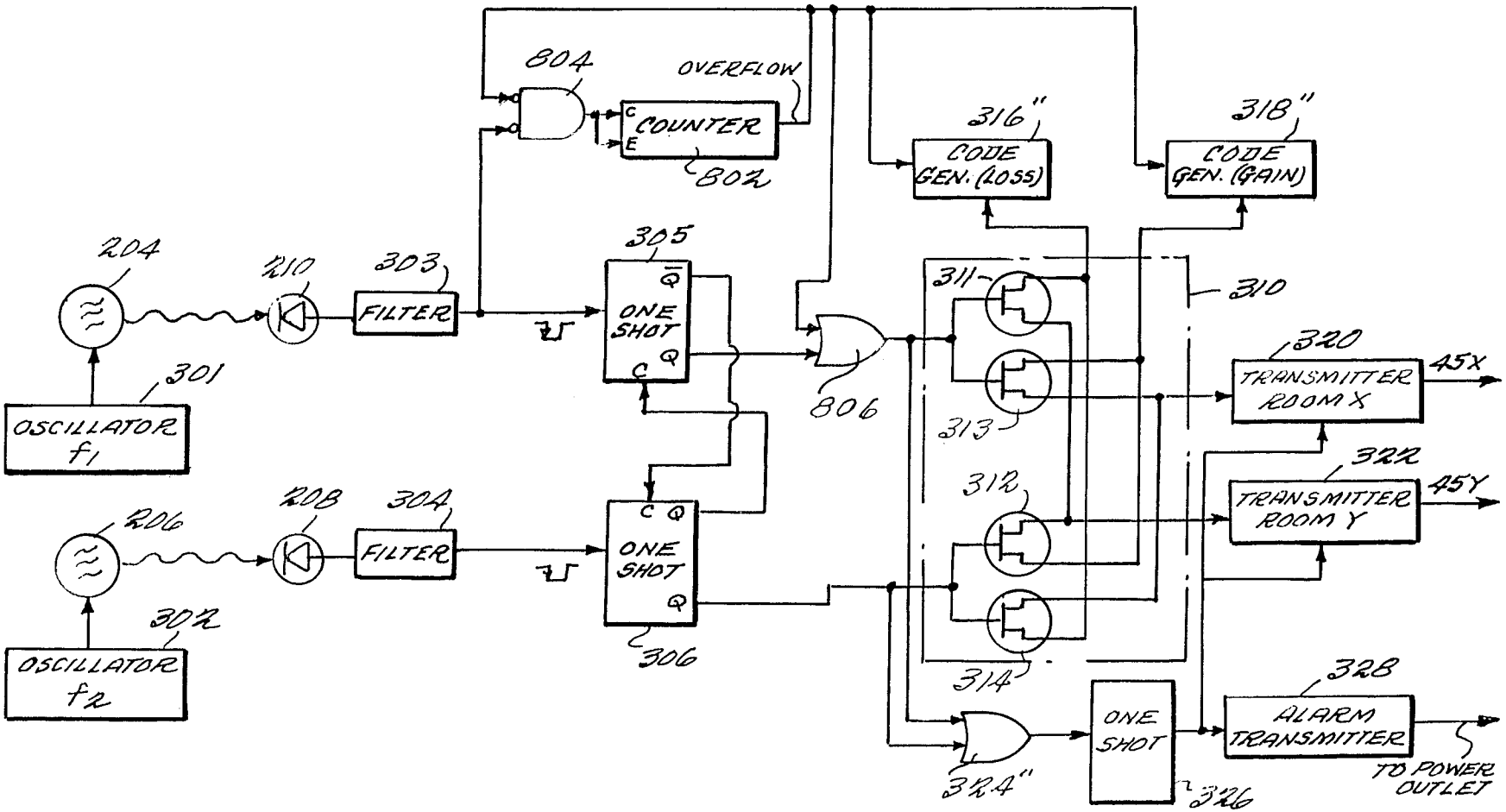
FIG. 8 is a block diagram and partial schematic diagram of a further embodiment of the present invention appropriate for passages fitted with doors.

FIG. 8 is a block diagram and partial schematic diagram showing a further modification of the motion detector of FIG. 3, which may be appropriate for passages that are fitted with doors. Like components are indicated by the same numerals used in FIG. 3. In the the present embodiment, when a beam is interrupted, a counter 802 is activated. In its resting state, counter 802 has an overflow bit which is in the low state. The overflow output is connected to an inverted input of AND gate 804, which receives as its second inverted input the output of filter 303. Whenever the light beam is interrupted, the output of filter 303 changes to a low state, thus causing AND gate 804 to generate a high output. The rising edge of the output of AND gate 804 clears counter 802, and the high output of AND gate 804 enables counter 802 to begin counting. Counter 802 continues to count until either the overflow bit changes to a high state or the output of filter 303 changes to a high state, thereby indicating that the beam is no longer interrupted. The number of counts needed before counter 802 reaches the overflow state is determined by the length of time considered appropriate before generating a closed door signal. Twenty seconds, thirty seconds, or any other desirable length of time may be chosen. When the beam has been interrupted longer than this predetermined interval of time, the overflow bit changes to a high state, thereby disabling the counter. The overflow bit is received by code generators 316" and 318", and a unique code is produced indicating that the door is closed. The overflow bit is also connected to one input of an OR gate 806, which outputs a signal activating switching network 310. The output of the code generators 316" and 318" are thus connected to the transmitters 320 and 322.

The high overflow bit is provided through gate 806 and gate 324" to one-shot 326 so that a transmit signal is produced. This causes a special code which indicates that the door has been closed to be transmitted to the monitoring device in rooms X and Y. If the closed door code is sensed by the monitor's microprocessor 412 later than a predetermined interval after a gain or loss code has been sensed, the microprocessor logic concludes that the beam across the passage has been interrupted by the closing of the door rather than the movement of a person. In this situation, no prompt is displayed. It should be noted that if a person enters or leaves the room and then closes the door behind him that a gain code or a loss code will be generated and then a closed door code will be generated. The gain code or the loss code will cause a prompt to be generated, but the closed door code will not.

Referring now to FIG. 9, a modified portion of the apparatus of FIG. 3 is shown. In the FIG. 9 embodiment, transmitters 320 and 322 are replaced by buffer memories 920 and 922, respectively. Buffer memories 920 and 922 store the gain or loss codes generated in the normal manner. The buffer memories may be interrogated by the monitor's microprocessor or a household collector (HUB) which is discussed in more detail with reference to FIG. 10. A destructive read is performed at recurring intervals in the microprocessor's program. In the above embodiments, the motion detector automatically interrupts the functioning of the microprocessor; however, in the FIG. 9 embodiment, the microprocessor's programming contains a routine for periodically checking the status of the motion detector. A flow diagram for such a program is discussed in more detail below with reference to FIG. 11.

In some television monitoring systems, there is little or no logical capability or storage in a monitoring device attached to the television set. Instead, the functions of the monitoring devices, and the information they detect, are controlled by, reported to, and stored in a single device sometimes called a household collector. The household collector communicates over the household main, over specially installed hardwires, or over RF with all the monitoring devices. In such systems, each monitoring device has a unique identification code, and each monitoring device reports to the household collector when interrogated. When the present invention is used with such systems, simplifications can be made in the invention, with corresponding functions being programmed into the household collector's microprocessor. An improved household collector for use with the present invention is shown with reference to FIG. 10.

FIG. 10 shows a distributed monitoring system in which each motion detector is treated as a separate doorway meter. Each doorway meter reports to a household collector (HUB) as to direction and whether the motion was by an adult or a child. Each doorway meter will have a small amount of buffer memory and may be polled as discussed above with reference to FIG. 9. In the HUB's microprocessor, each doorway meter is treated as a separate task, and prompts are generated by the appropriate monitoring devices upon the direction of the HUB.

The HUB is connected over a telephone network 1012 to a host computer system 1014 in the manner disclosed by McKenna. The HUB reports the status of the doorway meters, each television monitoring device within the household, and auxiliary devices. In the specific embodiment shown in FIG. 10, the HUB is shown controlling television meter 1020 and television meter 1030. Each of these television monitoring devices may generate a prompt on televisions 1021 and 1031, respectively, and viewers may respond to those prompts by utilizing user input devices 1022 and 1032, respectively. In addition, the HUB may monitor such auxiliary devices as a VCR meter 1040, which monitors the use of a VCR 1042, and a cable meter monitor 1050 with user input device 1051, which monitors the usage of a cable television set 1052.

In accordance with the present invention, the HUB monitors each doorway meter in the household. The HUB is connected to each doorway meter by a 2-way communication path over RF. When a dwelling unit is equipped with a HUB, receiver 402 as shown in FIG. 4 is replaced by a transceiver 1002 as shown in FIG. 10. Transceiver 1002 receives a buffer read signal from the HUB which is sent to buffer memories 920 and 922. The gain or loss code is then transmitted back to the HUB. Each transceiver will be equipped with a code so that each individual doorway meter can be identified by the HUB. This additional information is attached to the gain or loss code generated by the motion detection device of the present invention and stored in the memory of the HUB. In addition, each monitoring device will have its own unique code so that it can be identified by the HUB. The HUB then transmits the gain or loss code to the appropriate television meter so that a prompt can be generated on the screen of the television sets in the room or rooms where motion was detected. Finally, the HUB unit will collect, time stamp, log, and transfer to the remote host that information gathered by those meters installed on its local network.

In the exemplary embodiment of the present invention, the HUB network is a star configuration, with the HUB as the master. The HUB will poll the meters one at a time, expecting a response from each poll message. Meters may be polled as often as once per second, with some types of meters being polled less frequently. In addition, the HUB may establish an electronic mailbox for each meter, with a separate process defined for each meter, and at each meter, simple flags will be used to indicate the existence of valid data. Each message in either direction on the network will contain the meter address, a command byte specifying the type of message, the message sequence, and the desired data. For example, the HUB may send commands such as: "no data for you, send now if you have any" or "here's data for you, send data if you have any". Each monitoring unit may also send commands such as: "message received—no data from meter" or "message received—here's my data". All message traffic is initiated by the HUB by sending a single message packet that is addressed to a specific meter. Response is always expected from the meter and no meter can transmit except when specifically addressed by the HUB. The HUB may also use three different media for communication with its peripheral monitoring devices. These are hard wired, carrier current using the household main, and RF. The HUB unit may have interface slots for all three of the communication links as shown in FIG. 10. In this manner, the HUB may communicate with each monitoring device and each auxiliary monitoring device over a 2-way communication channel, and the HUB may communicate over a separate 2-way communication channel with the doorway meters.

As noted above, the HUB operates by polling each individual device on its communication network. Thus the HUB may interrogate television monitoring device 1020, then interrogate television monitoring device 1030, then interrogate auxiliary devices 1040 and 1050, and then interrogate each doorway meter. Thus in the microprocessor, each monitoring device and each doorway meter can be treated as a separate software task. An example of a doorway task in accordance with the present invention will be described with reference to FIG. 11.

Figure 11:
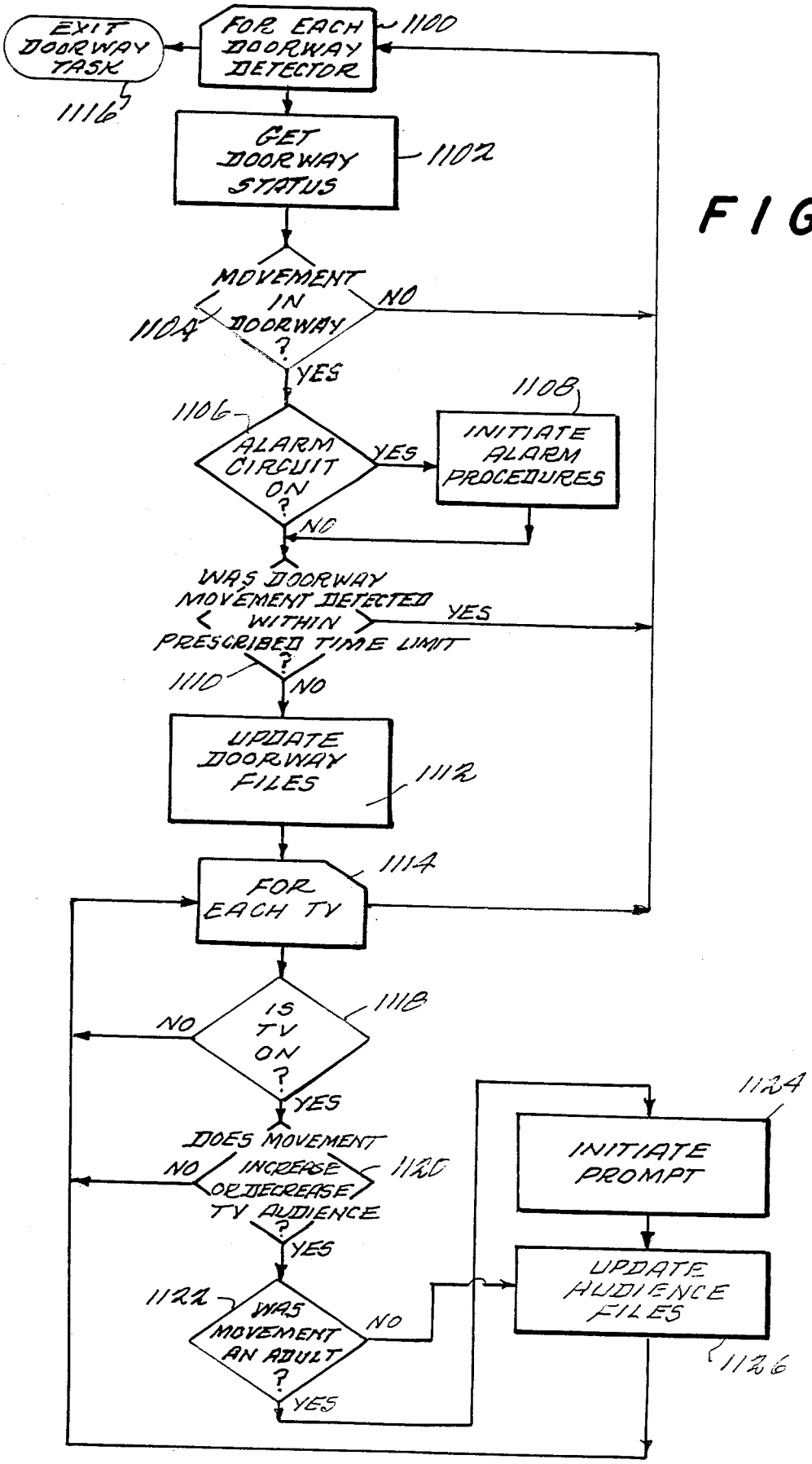
FIG. 11 is a logic flow diagram relating to an audience monitoring system using the household collector shown in FIG. 10.

FIG. 11 shows a logic flow diagram for a doorway task utilized by the microprocessor for each doorway meter. The HUB's microprocessor calls up the doorway task stored in its memory unit and performs it for each meter in the house (step 1100). The microprocessor generates a polling signal which passes through the RF interface to the desired transceiver unit 1002. The read signal 902 is then transmitted to the buffer memory units 920 and 922. The buffer memory units are read and their outputs are transmitted back over lines 45X or 45Y to transceiver unit 1002. Upon receipt of this information, the transceiver 1002 transmits the gain or loss code to the RF interface, and the doorway information is placed in the HUB's memory (step 1102). The received signal is then checked to see if a valid code was received (step 1104). If no gain or loss signal or a special code signal was received, the doorway task for that meter is exited. If a gain or a loss signal was received, however, the microprocessor knows that movement in the doorway has been detected. When such movement in the doorway has been detected, the microprocessor then determines if the user has turned on the alarm circuit (step 1106). If the alarm circuit is on, the microprocessor will send an output signal to alarm transmitter 328 over the household main (step 1108). The microprocessor will then return to the next step in the doorway program. When the alarm circuit is off or after the alarm procedures have been initiated, the microprocessor will wait a predetermined interval of time after receiving the doorway status before the microprocessor will generate a signal indicating that motion has been detected (step 1110). In other words, if a gain signal and a loss signal or a loss signal and a gain signal have been received from the buffer memory, the microprocessor will not update the files to indicate that motion has occurred, and the doorway task for that meter is exited. On the other hand, if no doorway movement occurred within the prescribed time (no subsequent gain or loss signal was received in the predetermined interval), the HUB's doorway files are updated (step 1112).

After determining whether motion has been detected, the microprocessor then checks for each television in a room adjacent to the motion detector (step 114) whether the television and television monitoring device are on (step 1118). If the television and television monitoring device are off, the microprocessor will then poll the next television meter. For each television that is on, the microprocessor will then determine whether the received signal was a gain signal or a loss signal (step 1120). Then for households equipped with motion detection devices which distinguish children (FIG. 7), the microprocessor determines whether the movement was that of an adult or a child (step 1122). If the movement was that of a child, the microprocessor will update the status of each monitoring device to indicate that a child has entered or exited the room, but no prompt will be generated (step 1126). However, if the received code indicates that the movement was that of an adult, the microprocessor will update the status of the television monitoring device to indicate that an adult has entered or exited the room, and an overlay enable signal will be generated so that a prompt will appear on the television screen (step 1124). The user for that particular television will respond to the prompt, and the status of that monitoring device will be updated (step 1126). This process will continue for each television and television monitoring device adjacent the passageway containing the polled doorway meter, and the program will continue for each doorway meter in the dwelling unit. The HUB continually polls all of the monitoring devices, and the HUB's memory stores all the information received from the monitoring devices and the doorway meters. This information is later transmitted over the telephone network 1012 to the host computer system 1014 in the manner disclosed by McKenna.

Only one particular HUB design has been described in detail above. Of course, those skilled in the art will realize that the present invention could be used with many alternative HUB designs. The specific design of the HUB plays no role in this invention.

Each television device which is monitored by the household collector (HUB) of the present invention may also include a code which identifies that particular television. Consequently, when a television is moved from room to room within the dwelling unit, the HUB will be able to keep track of which room the television is in if the user inputs to the HUB which room the television was moved to. The user could do this by setting a manual room identification code selector whenever the television is moved to a different room. The change in the setting of this selector alters the unique code for the relocated monitoring device, which controls its communication with the household collector, thereby informing the household collector the room in which a television set and monitor is currently located. However, use of this approach is likely to result in erroneous results if the panel member fails to set the manual selector correctly or in a timely fashion.

In another embodiment of an audience monitoring system using a HUB, a monitoring device may be used to pick up the code from each doorway meter as in the FIG. 3 embodiment and store it in its memory. The HUB could then poll each monitoring device for data received from each of the doorway meters and data received by the monitoring devices. The household collector would then store the received code and the time and transmit proper instructions to each monitoring device for the display of a prompt if necessary.

Further simplifications are feasible in households meeting certain conditions, such as households having only one television set to be monitored or in which none of the several television sets is moved from room to room. In such dwelling units, transmitters 320, 322 and 328 can be reduced to a single transmitter which produces a unique code indicating its passage location and which communicates this code along with the other information described in connection with FIG. 3 to the household collector. All components in FIG. 4 could then be eliminated. With this arrangement, the HUB microprocessor's storage would contain information on the room location of each television set and the identity of the rooms on either side of each passage. Based on this information, the HUB could instruct the appropriate monitoring device to display the prompts and store the responses. The HUB could also contain auto-dialer capability to place a call to the authorities when an unauthorized intrusion has been detected.

Although only a few exemplary embodiments of this invention have been described in detail above, those skilled in the art will readily appreciate that many modifications are possible in the preferred embodiments without materially departing from the novel teachings and advantages of this invention. For example, other means of detecting motion between rooms such as the installation of treadles or pads in the floor of each side or the passage may be used. The light beams may also be replaced by lasers where suitable. Other types of motion detection devices are within the scope of the present invention.

Accordingly, all such modifications are intended to be included in this invention as defined by the following claims.

What is claimed is:

1. Apparatus for monitoring the population in a room containing a device, said apparatus comprising:

means for detecting the entry and exit of people from said room; and means for monitoring the status of said device, said monitoring means including means responsive to said detecting means for prompting people in said room to input additional information to said monitoring means when said detecting means detects entry or exit from said room.

2. Apparatus according to claim 1, wherein:

said detecting means includes light emitters and photocells arranged on opposite sides of each passage to said room such that said photocells receive uninterrupted beams of light from said light emitters, interruption of said beams of light indicating entry or exit from said room.

3. Apparatus according to claim 2, wherein:

said light emitters and said photocells are arranged such that two beams of light, parallel to each other, cross each passage to said room at a first height, said beams of light at said first height being interrupted by the entry or exit of a small child or an adult from said room, and another two beams of light, parallel to each other, cross each passage to said room at a second height, said second height chosen such that said beams of light at said second height are not interrupted by the entry or exit of a small child from said room; and said prompting means is actuated only when all of said beams are interrupted.

4. Apparatus according to claim 2, wherein:

said detecting means includes timing means which is activated when at least one of said beams of light is interrupted, said timing means remaining activated until the beams of light are no longer interrupted or until a predetermined interval of time has passed, whichever first occurs, said timing means producing a unique code when said predetermined interval has passed and the beams of light are still interrupted, said unique code indicating that a door across the passage to said room is closed.

5. Apparatus according to claim 1, wherein:

said detecting means generates a gain signal when a person enters said room and generates a loss signal when a person exits said room.

6. Apparatus according to claim 5, wherein:

said detecting means includes means for transmitting said gain signal and said loss signal over infrared frequencies to said monitoring means when entry or exit from said room is detected, said monitoring means further including a memory means for storing the time of day and said gain signal or said loss signal.

7. Apparatus according to claim 1, further comprising:

an alarm means connected to said detecting means, said alarm means being activated when said detecting means detects an unauthorized intrusion into said room.

8. Apparatus according to claim 1, further comprising:

means for manually inputting the identification of people in said room in response to said prompting.

9. Apparatus for monitoring the population in a room containing a video display means, said apparatus comprising:

means for detecting the entry and exit of people from said room;

video monitoring means for monitoring the status of said video display means, said video monitoring means including means, responsive to said detecting means, for prompting people in said room to input additional information to said video monitoring means when said detecting means detects entry or exit from said room.

10. Apparatus according to claim 9, wherein said detecting means includes light emitters and photocells arranged on opposite sides of each passage to said room such that said photocells receive uninterrupted beams of light from said light emitters, interruption of said beams of light indicating entry or exit from said room.

11. Apparatus according to claim 10, wherein:

said light emitters and said photocells are arranged such that two beams of light, parallel to each other, cross each passage to said room at a first height, said beams of light at said first height being interrupted by the entry or exit of a small child or an adult from said room, and another two beams of light, parallel to each other, cross each passage to said room at a second height, said second height chosen such that said beams of light at said second height are not interrupted by the entry or exit of a small child from said room; and said prompting means is actuated only when all of said beams are interrupted.

12. Apparatus according to claim 10, wherein:

said detecting means includes timing means which is activated when at least one of said beams of light is interrupted, said timing means remaining activated until the beams of light are no longer interrupted or until a predetermined interval of time has passed, whichever first occurs, said timing means producing a unique code when said predetermined interval has passed and the beams of light are still interrupted, said unique code indicating that a door across the passage to said room is closed.

13. Apparatus according to claim 9, wherein:

said detecting means generates a gain signal when a person enters said room and generates a loss signal when a person exits said room.

14. Apparatus according to claim 13, wherein:

said detecting means includes means for transmitting said gain signal and said loss signal over infrared frequencies to said video monitoring means when entry or exit from said room is detected, said video monitoring means further including a memory means for storing the time of day and said gain signal or said loss signal.

15. Apparatus according to claim 13, wherein:

said video monitoring means includes a processing means and a memory means, wherein said processing means is responsive to said detecting means and sends an enable signal to said prompting means when said detecting means detects entry or exit from said room, and wherein said memory means stores the time of day and said gain signal or said loss signal.

16. Apparatus according to claim 15, wherein:

said memory means further stores data representing the status of said video display means, said memory means being controlled by said processing means such that said gain signal or said loss signal is provided to said prompting means when said processing means sends said enable signal.

17. Apparatus according to claim 15, wherein:

said processing means waits a predetermined interval of time after said memory means has stored said gain signal or said loss signal and the time of day before said processing means sends said enable signal to said prompting means, said predetermined interval of time determined such that when said detecting means generates said gain signal and said loss signal, or said loss signal and said gain signal, in rapid succession, no prompt will be generated.

18. Apparatus according to claim 15, wherein:

said prompting means generates a prompt on a video display screen of said video display means when said enable signal is received from said processing means, said video monitoring means including a user inputting means for manually inputting data including the identification of people in said room.

19. Apparatus according to claim 15, wherein:

said detecting means contains a buffer memory for each room on either side of a passage equipped with said detecting means, each buffer memory storing said gain signal or a said loss signal, wherein the contents of each buffer memory are read by said video monitoring means at periodic intervals.

20. Apparatus according to claim 9, further comprising:

an alarm means connected to said detecting means, said alarm means being activated when said detecting means detects an unauthorized intrusion into said room.

21. Apparatus according to claim 9, further comprising:

means for manually inputting the identification of people in said room in response to said prompting.

22. Apparatus according to claim 9, wherein:

said video monitoring means consists of a distributed monitoring system for a house, said distributed monitoring system monitoring the status of one or more of said video display means in said house and monitoring with one or more of said detecting means the entry and exit of people from the rooms in said house.

23. Apparatus according to claim 22, further comprising:

an alarm means connected to said distributed monitoring system, said alarm means being activated when at least one of said detecting means detects an unauthorized intrusion into said house.

24. Apparatus according to claim 22, wherein:

said distributed monitoring system includes a processing means and a memory means, said processing means coordinating data received from each of said detecting means and each of said video display means and sending an enable signal to said prompting means such that a prompt is generated for each video display means in a room of said house in which one of said detecting means has detected at least one of entry and exit of people, and said memory means storing the time of day and a gain signal or a loss signal which are generated by said detecting means when a person enters or exits a room of said house, respectively.

25. Apparatus according to claim 24, wherein:

said processing means waits a predetermined interval of time after said memory means has stored said gain signal or said loss signal and the time of day before said processing means sends said enable signal to said prompting means, said predetermined interval of time determined such that when said means for detecting generates said gain signal and said loss signal, or said loss signal and said gain signal, in rapid succession, no prompt will be generated.

26. Apparatus according to claim 22, further comprising:

a switched telephone network coupled to said distributed monitoring system and a central collector, coupled to said network, which includes a host computer system for gathering data collected by said distributed monitoring system.

27. A system for collecting data from television viewers, including a plurality of remote units at a plurality of viewer locations, each of said remote units monitoring the population in a room containing a television receiver and comprising:

means for detecting the entry and exit of people from said room, said detecting means including light emitters and photocells arranged on opposite sides of each passage to said room such that said photocells receive uninterrupted beams of light from said light emitters, the interruption of said beams of light by a person entering said room causing a gain signal to be generated, and the interruption of said beams of light by a person exiting said room causing a loss signal to be generated; and video monitoring means for monitoring the status of said television receiver, said video monitoring means including means responsive to said gain signal or said loss signal for generating a prompt requesting a user to input data including the identification of people in said room to said video monitoring means, wherein said video monitoring means further comprises:

processing means, responsive to said gain signal or said loss signal, for sending an enable signal to said means for generating a prompt; and memory means, controlled by said processing means, for storing the time of day, said gain signal or said loss signal, and data representing the status of said television receiver, said memory means providing said gain signal or said loss signal to said means for generating a prompt when said processing means sends said enable signal.

28. A system according to claim 27, further comprising:

alarm means connected to said detecting means, said alarm means being activated when said detecting means detects an unauthorized intrusion into said room.

29. A system according to claim 27, wherein:

said detecting means transmits said gain signal and said loss signal over infrared frequencies to said video monitoring means.

30. A system according to claim 27, wherein:

said light emitters and said photocells are arranged such that two beams of light, parallel to each other, cross each passage to said room at a first height, said beams of light at said first height being interrupted by the entry or exit of a small child or an adult from said room, and another two beams of light, parallel to each other, cross each passage said room at a second height, said second height chosen such that said beams of light at said second height are not interrupted by the entry or exit of a small child from said room, said means for generating a prompt does not generate a prompt when only said beams of light at said first height are interrupted, and said video monitoring means updates the status of said video display means to indicate that a small child has entered or exited said room when only said beams of light at said first height are interrupted.

31. A system according to claim 27, wherein:

said detecting means includes a timing means which is activated when at least one of said beams of light is interrupted, said timing means remaining activated until the beams of light are no longer interrupted or until a predetermined interval of time has passed, whichever first occurs, said timing means producing a unique code when said predetermined interval has passed and the beams of light are still interrupted, said unique code indicating that a door across the passage to said room is closed.

32. A system according to claim 27, wherein:

said processing means waits a predetermined interval of time after said memory means has stored said gain signal or said loss signal and the time of day before said processing means sends said enable signal to said means for generating a prompt, said predetermined interval of time determined such that when said means for detecting generates said gain signal and said loss signal, or said loss signal and said gain signal, in rapid succession, no prompt will be generated.

33. A system according to claim 27, wherein:

said detecting means contains a buffer memory for each room on either side of a passage equipped with said means for detecting, each buffer memory storing said gain signal or said loss signal, and wherein the contents of each buffer memory are read by said video monitoring means at periodic intervals.

34. A system according to claim 27, wherein:

said video monitoring means consists of a distributed monitoring system for a house, said distributed monitoring system monitoring the status of one or more television receivers in said house and monitoring with one or more of said detecting means the entry and exit of people from the rooms in said house.

35. A system according to claim 34, further comprising:

alarm means connected to said distributed monitoring system, said alarm means being activated when at least one of said detecting means detects an unauthorized intrusion into said house.

36. A system unit according to claim 34, wherein:

said distributed monitoring system includes a household collector which coordinates data received from each of said detecting means and status data received from each of said television receivers, wherein the status data from each of said television receivers is stored in a meter corresponding to each television receiver, said household collector acquires said status data from each meter at periodic intervals, and wherein a prompt is generated for each television receiver in a room of said house in which said gain or said loss signal has been generated by one of said detecting means.

37. A system according to claim 36, wherein:

said processing means waits a predetermined interval of time after said memory means has stored said gain signal or said loss signal and the time of day before said processing means sends said enable signal to said means for generating a prompt, said predetermined interval of time determined such that when said means for detecting generates said gain signal and said loss signal, or said loss signal and said gain signal, in rapid succession, no prompt will be generated.

38. A system according to claim 34, further comprising:

a switched telephone network coupled to said distributed monitoring system and a central collector coupled to said network which includes a host computer system for gathering data collected by said distributed monitoring system.

39. A method of monitoring the population in a room containing a device, comprising the steps of:

monitoring the status of said device;

detecting the entry and exit of people from said room; and prompting people in said room to provide additional information when said detecting step detects entry or exit from said room.

40. A method in accordance with claim 39, wherein said detecting step includes the steps of:

generating a gain signal when a person enters said room;

generating a loss signal when a person exits said room;

storing a time of day and said gain signal or said loss signal.

41. A method in accordance with claim 40, wherein:

light emitters and photocells are arranged such that two beams of light, parallel to each other, cross each passage to said room such that said photocells receive uninterrupted beams of light from said light emitters at a first height, said beams of light at said first height being interrupted by the entry or exit of a small child or an adult from said room, and another two beams of light, parallel to each other, cross each passage to said room at a second height, said second height chosen such that said beams of light at said second height are not interrupted by the entry or exit of a small child from said room; and said method further comprises the steps of:

generating a prompt when said beams of light at said first height and at said second height are approximately simultaneously interrupted; and updating the status of said device to indicate that a small child has entered or exited said room when only said beams of light at said first height are interrupted.

42. A method in accordance with claim 40, including the further steps of:

timing the interruption of at least one of said beams of light until the beams of light are no longer interrupted or until a predetermined interval of time has passed, whichever first occurs; and producing a unique code when said predetermined interval has passed and the beams of light are still interrupted, said unique code indicating that a door across the passage to said room is closed.

43. A method in accordance with claim 39, including the further step of:

generating an alarm when said detecting step detects an intrusion into said room and said alarm is activated.

44. A method of monitoring the population in a room containing a video display means, comprising the steps of:

monitoring the status of said video display means;

detecting the entry and exit of people from said room; and prompting people in said room to provide additional information when said detecting step detects entry or exit from said room.

45. A method in accordance with claim 44, wherein said detecting step includes the steps of:

generating a gain signal when a person enters said room;

generating a loss signal when a person exits said room; and storing a time of day and said gain signal or said loss signal.

46. A method in accordance with claim 45, including the further step of:

waiting a predetermined interval of time after storing the time of day and said gain signal or said loss signal before said prompting step, said predetermined interval of time determined such that when said generating steps generate said gain signal and said loss signal, or said loss signal and said gain signal, in rapid succession, no prompt will be generated.

47. A method in accordance with claim 45, further including the step of:

reading data stored in said storing step at periodic intervals.

48. A method of collecting data from selected television viewers, said data including the identification of people in each room containing a television receiver, comprising the steps of:

detecting the entry and exit of people from each of said rooms with light emitters and photocells arranged on opposite sides of each passage to each of said rooms such that said photocells receive uninterrupted beams of light from said light emitters;

generating a gain signal when at least one of said beams of light is interrupted by a person entering each of said rooms;

generating a loss signal when at least one of said beams of light is interrupted by a person exiting each of said rooms;

monitoring the status of said television receiver and receiving said gain signal and said loss signal;

storing the time of day, said gain signal or said loss signal, and data representing the status of said television receiver; and generating a prompt requesting a user to input data including the identification of people in each of said rooms to said video monitoring means in response to said gain signal or said loss signal.

49. A method in accordance with claim 48, including the further step of:

generating an alarm when said detecting step detects an unauthorized intrusion into each of said rooms and said alarm is activated.

50. A method in accordance with claim 48, wherein:

said detecting step is performed with said light emitters and said photocells arranged such that two beams of light, parallel to each other, cross each passage to each of said rooms at a first height, said beams of light at said first height being interrupted by the entry or exit of a small child or an adult from each of said rooms, and another two beams of light, parallel to each other, cross each passage to each of said rooms at a second height, said second height chosen such that said beams of light at said second height are not interrupted by the entry or exit of a small child from each of said rooms;

said generating step generates said prompt when said beams of light at said first height and at said second height are approximately simultaneously interrupted; and said storing step includes the step of updating the status of said television receiver to indicate that a small child has entered or exited each of said rooms when only said beams of light at said first height are interrupted.

51. A method in accordance with claim 48, including the further steps of:

timing for interruption of at least one of said beams of light until the beams of light are no longer interrupted or until a predetermined interval of time has passed, whichever first occurs; and producing a unique code when said predetermined interval of time has passed and the beams of light are still interrupted, said unique code indicating that a door across the passage to each of said rooms is closed.

52. A method in accordance with claim 48, including the step of:

waiting a predetermined interval of time after storing the ime of day and said gain signal or said loss signal before generating said prompt, said predetermined interval of time determined such that when said means for detecting generates said gain signal and said loss signal, or said loss signal and said gain signal, in rapid succession, no prompt will be generated.

53. A method of monitoring the population in each room containing a television receiver in a house, said house equipped with a distributed monitoring system for monitoring the status of at least one of said television receivers in said house and for monitoring the motion of people to or from each room containing a television receiver, comprising the steps of:

detecting the entry and exit of people from each room containing a television receiver, with light emitters and photocells arranged on opposite sides of each passage to each of said rooms such that said photocells receive uninterrupted beams of light from said light emitters;

generating a gain signal when at least one of said beams of light is interrupted by a person entering said room;

generating a loss signal when at least one of said beams of light is interrupted by a person exiting said room;

transmitting said gain signal or said loss signal at periodic intervals;

storing said gain signal or said loss signal transmitted in said transmitting step;

determining if an alarm means is activated;

initiating an alarm if said alarm means is activated and said gain signal or said loss signal has been received;

determining if a gain signal and a loss signal or a loss signal and a gain signal were received from one of said rooms in rapid succession when said alarm means was not activated;

for each television receiver in said house, determining if said television receiver is activated;

determining if said detecting steps detects an adult or a child; and generating a prompt on said television receiver when the entry or exit of any adult from the room containing said television is detected, said television receiver is determined to be activated and said signals are not determined as being generated in rapid succession, said prompt requesting that data representing the population of people in the room be inputted.

54. A method of monitoring the population in each of a plurality of rooms containing a video display means, comprising the steps of:

(a) detecting the entry and exit of people from each of said rooms;

(b) monitoring the status of at least one of said video display means;

(c) monitoring said detecting step (a) and said status monitoring step (b) from a central location in said house; and (d) generating, in response to said monitoring step (c) determining that at least one of entry and exit has occurred in one of said rooms with said video display means activated, a prompt for said video display means in said one of said rooms.

55. A method in accordance with claim 54, including the further step of:

generating an alarm when said detecting step detects an intrusion into one of said rooms and said alarm is activated.

56. A method in accordance with claim 54, including the further step of:

transmitting data collected at said central location to a host computer system.

* * * * *

UNITED STATES PATENT AND TRADEMARK OFFICE

CERTIFICATE OF CORRECTION

PATENT NO. : 4,779,198

DATED : October 18, 1988

INVENTOR(S) : LURIE, Oscar M.

It is certified that error appears in the above-identified patent and that said Letters Patent is hereby corrected as shown below:

COL. 6, LINES 24-25:

Reads: "on a passage into or between rooms X opposing faces of the passage (the door and Y. The jambs or walls) are"

Should Read: --on a passage into or between rooms X and Y. The opposing faces of the passage (the door and jambs or walls) are"

COL. 11, LINE 56:

Reads: "302, 208, 210, 30,, 304, 305 and 306 are duplicated, with"

Should Read: --302, 208, 210, 303, 304, 305 and 306 are duplicated, with--

COL. 15, LINE 60:

Reads: "room adjacent to the motion detector (step 114)"

UNITED STATES PATENT AND TRADEMARK OFFICE

CERTIFICATE OF CORRECTION

PATENT NO. : 4,799,198

DATED : October 18, 1988

INVENTOR(S) : Lurie, Oscar M.

It is certified that error appears in the above-identified patent and that said Letters Patent is hereby corrected as shown below:

Should Reads: "room adjacent to the motion detector (step 1114)--

Signed and Sealed this

Twenty-third Day of May, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,779,198

DATED : October 18, 1988

INVENTOR(S) : LURIE, Oscar M.

It is certified that error appears in the above-identified patent and that said Letters Patent is hereby corrected as shown below:

COL. 6, LINES 24-25:

Reads: "on a passage into or between rooms X opposing faces of the passage (the door and Y. The jambs or walls) are"

Should Read: --on a passage into or between rooms X and Y. The opposing faces of the passage (the door jambs or walls) are--.

COL. 11, LINE 56:

Reads: "302, 208, 210, 30,, 304, 305 and 306 are duplicated, with"

Should Read: --302, 208, 210, 303, 304, 305 and 306 are duplicated, with--

UNITED STATES PATENT AND TRADEMARK OFFICE

CERTIFICATE OF CORRECTION

PATENT NO. : 4,779,198

DATED : October 18, 1988

INVENTOR(S) : LURIE, Oscar M.

It is certified that error appears in the above-identified patent and that said Letters Patent is hereby corrected as shown below:

COL. 15, LINE 60:

Reads: "room adjacent to the motion detector (step 114)"

Should Read: --room adjacent to the motion detector (step 1114)--.

This Certificate supersedes Certificate of Correction issued May 23, 1989.

Signed and Sealed this

Twelfth Day of December, 1989

*Attest:*

JEFFREY M. SAMUELS

*Attesting Officer* *Acting Commissioner of Patents and Trademarks*